US005464148A

United States Patent [19]

Schoch et al.

[11] Patent Number: 5,464,148

[45] Date of Patent: Nov. 7, 1995

[54] PACKING CARTON

[75] Inventors: Reinhard Schoch; Walter Marten, both of Hamburg, Germany

[73] Assignee: H.F. & PH.F. Reemtsma GmbH & Co., Hamburg, Germany

[21] Appl. No.: 289,677

[22] Filed: Aug. 12, 1994

[30] Foreign Application Priority Data

Aug. 13, 1993 [DE] Germany ..... 43 27 681.4

[51] Int. Cl.[6] ..... B65D 5/50

[52] U.S. Cl. ..... 229/109; 220/416; 220/418; 229/199; 229/229; 229/900

[58] Field of Search ..... 229/23 R, 109, 229/199, 229, 900; 220/416, 418, 445; 206/594

[56] References Cited

U.S. PATENT DOCUMENTS

| | | | |
|---|---|---|---|
| 2,229,355 | 1/1941 | Watkins | 229/199 |
| 2,472,079 | 6/1949 | James et al. | 229/109 |
| 2,827,221 | 3/1958 | Vines | 220/416 |
| 3,126,144 | 3/1964 | McCulloch | 229/199 |
| 3,397,831 | 8/1968 | Adams | 229/199 |
| 3,516,593 | 6/1970 | Larsen | 220/418 |
| 3,554,431 | 1/1971 | Lock | 220/416 |
| 4,623,063 | 11/1986 | Balkin | 229/109 |
| 4,834,255 | 5/1989 | Boots | 229/109 |
| 4,944,394 | 7/1990 | Campbell | 220/418 |

*Primary Examiner*—Gary E. Elkins
*Attorney, Agent, or Firm*—Foley & Lardner

[57] ABSTRACT

A shape-stable packing carton with an octagonal cross-section has an interior working space with a rectangular cross-section for the accommodation of a bundle of cigarette packets or other rectangular objects and side portions at both sides of the working space with a cross-section forming an equilateral trapezoid with a base line directed along the side wall of the working space. The shape stability of the packing carton is ensured by reinforcing inserts of the same material fixed in the side portions thereof. Each insert consists of a blank in which a surface corresponding to the side wall of the working space is formed, by folding and gluing, with a parallel pair of channels, running in the longitudinal direction of the packing carton, with a rectilinear cross-section. The channels are formed by defined pressing-together of the rectangular end portions forming the channels into rhombi which are inclined towards one another in such a way that the cross-section of the thus-formed insert conforms to the cross-section of the side portions. The inserts are glued in this state to the side walls of the packing carton.

8 Claims, 6 Drawing Sheets

PACKING CARTON

TECHNICAL FIELD

The invention relates to a packing carton for the packaging of cigarette packets in the form of a bundle and to a process for its manufacture.

BACKGROUND OF THE INVENTION

According to the known prior art, the packing carton consists of two components, a sliding part for accommodating the bundle and a sleeve part into which the sliding component is inserted. The sleeve part of the packing carton has an essentially rectangular cross-section, the edges of which are folded for design reasons, and the packing carton therefore has an octagonal cross-section in its actual version. The working space of the packing carton is defined by the sliding part and is located between the top surface and the base surface which face one another in congruent manner. The stacking area of the cigarette packets, i.e. the base surface of the bundle, corresponds to the base surface, and the stacking height of the cigarette packets, i.e. the height of the bundle, corresponds to the distance between base surface and top surface of the packing carton.

Cavities having a trapezoidal-shaped cross-section are formed by the described version of the sleeve part at both sides of the working space defined by the sliding part. These cavities prevent the sleeve part from being structurally stable. As is known, these cavities are filled up by suitably-shaped inserts made of foamed material which are fixed in the side walls of the packing carton in order to thereby ensure shape stability of the sleeve part of the packing carton. The disadvantage of the described packing carton is that its two-part version with the inserted side parts made from foamed material, i.e. a second material component, requires a comparatively high use of material and makes pre-manufacturing of the packing carton difficult.

It is known from German patent publication DE-GM 91 16 739.6 to manufacture a packing carton from a flat material by bending about a core in octagonal form. After assembling the blank, the core is removed and the packing carton filled without additional strengthening of the side walls. The possibility of resealing is not provided for.

Known from European patent publication EP 0 346 025 A1 is a packing carton in rectangular form, into which inserts or fillers are introduced in order to package smaller objects which are unable to take up the whole cross-section of the carton. Adaptation to a form other than a rectangular form is not provided, the same holds for resealability.

Finally, it is known from U.S. Pat. No. 3,221,973 to strengthen a rectangular carton using inserts which have dovetail profile boxes formed by parallel incisions and subsequent folding and pasting to give boxes. For this purpose, the walls of the profile boxes are inclined alternately towards the inside and towards the outside, so that only a rectangular carton comes into consideration as a covering.

It is the object of the invention to provide a single-part packing carton in octagonal form having a high shape stability independent of the degree of its filling with cigarette packets, and which can be resealed after tearing open.

SUMMARY OF THE INVENTION

A packing carton according to the invention includes a carton body having an octagonal cross-sectional shape and an octagonal interior working space where a bundle of cigarette packets or other rectangular objects can be stored. A pair of reinforcing inserts having a trapezoidal cross-sectional shape geometrically similar to a pair of opposed side portions of the interior of the carton body are disposed in the side portions of the interior of the carton body. Each insert comprises a single folded blank having a pair of end portions which have been folded and pressed into a rhombohedral shape in order to fit within the side portions of the interior of the carton body. The inserts are preferably glued into place against side walls of the carton body and act as reinforcing spacers so that the remaining interior space of the carton is rectangular and can be completely filled with rectangular objects such as bundles of cigarettes. The inserts of the invention, which are preferably made of a paperboard or cardboard as is well known in the art, also provide the carton with shape stability, i.e., the ability to retain its shape with appropriate stiffness even when the carton is empty or only partly full.

The invention further provides a method for assembling a carton having the foregoing components, as well as blanks useful for forming the carton body and inserts. According to the method of the invention, a pair of preformed inserts according to the invention are positioned on corresponding spaced-apart side panels of a blank that will be used to form the carton body, and a top wall of each insert is secured to the inner surface of the blank by suitable means such as gluing. The shape of the inserts is then adjusted to the desired trapezoidal shape by the fingers of a gripping machine inserted into the open ends of the inserts. Rectangular objects such as cigarette bundles are then loaded on the central space of the blank between the two inserts, and the blank is then folded about the bundles to form the carton body. Suitable end and side tabs of the carton body are folded in and preferably glued in place to complete assembly of the carton.

According to a preferred form of the invention, the inserts and carton body, when assembled, have a generally uniform cross-sectional shape along the entire length of each component. Thus, the carton body has eight octahedral faces, preferably including four narrow faces which form corners of the carton alternating with four wider faces which form side panels of the carton. One of the side panels has a pair of tabs extending from opposite ends thereof configured for forming the top of and bottom walls of the carton. These and other aspects of the invention are described further in the detailed description which follows.

BRIEF DESCRIPTION OF THE DRAWINGS

The invention will be described with reference to the accompanying drawings, wherein like numerals denote like elements, and.

DETAILED DESCRIPTION OF PREFERRED EMBODIMENT

Figure 1:
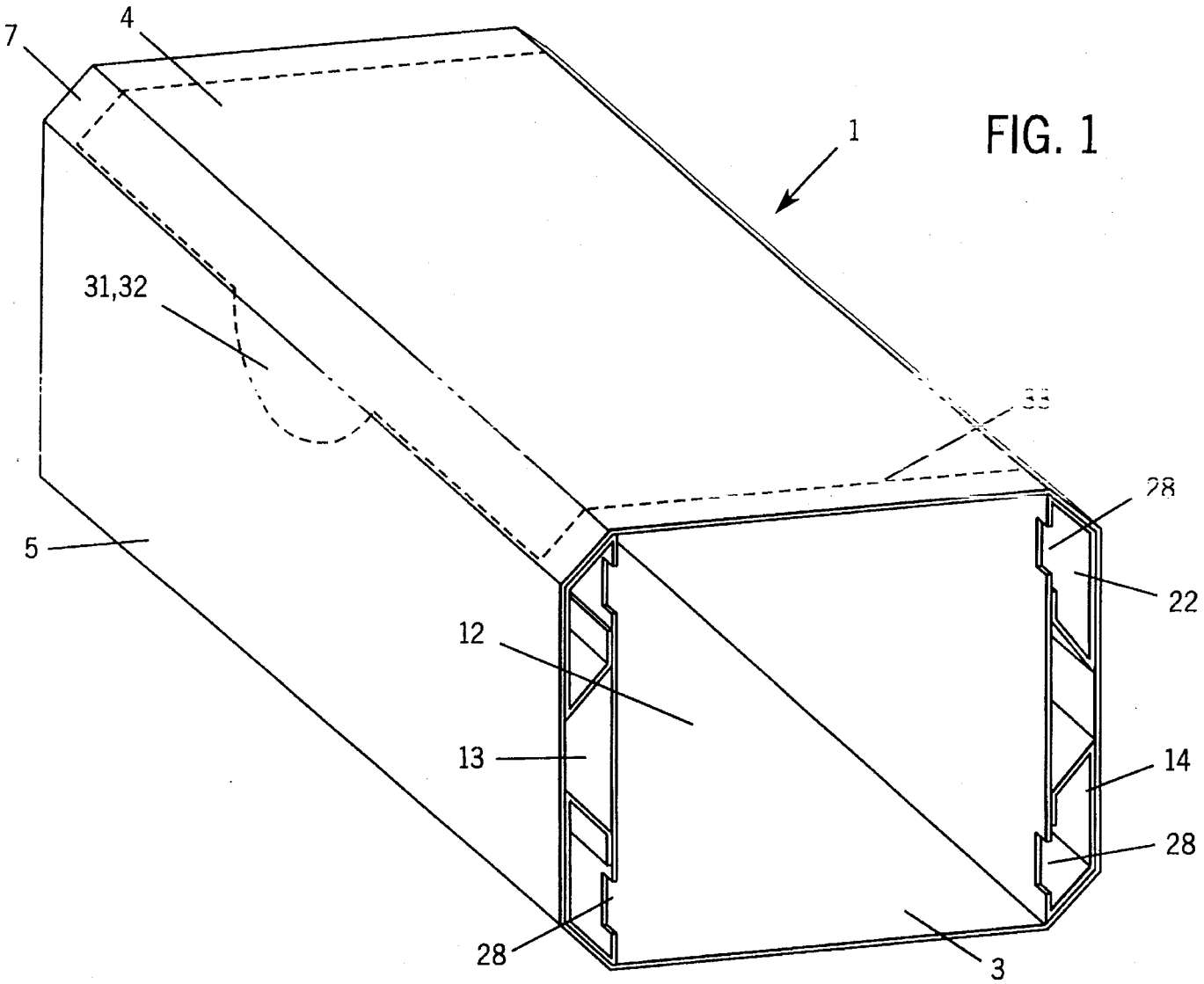
FIG. 1 is a perspective view of a packing carton of the invention open at the front.
Figure 2:
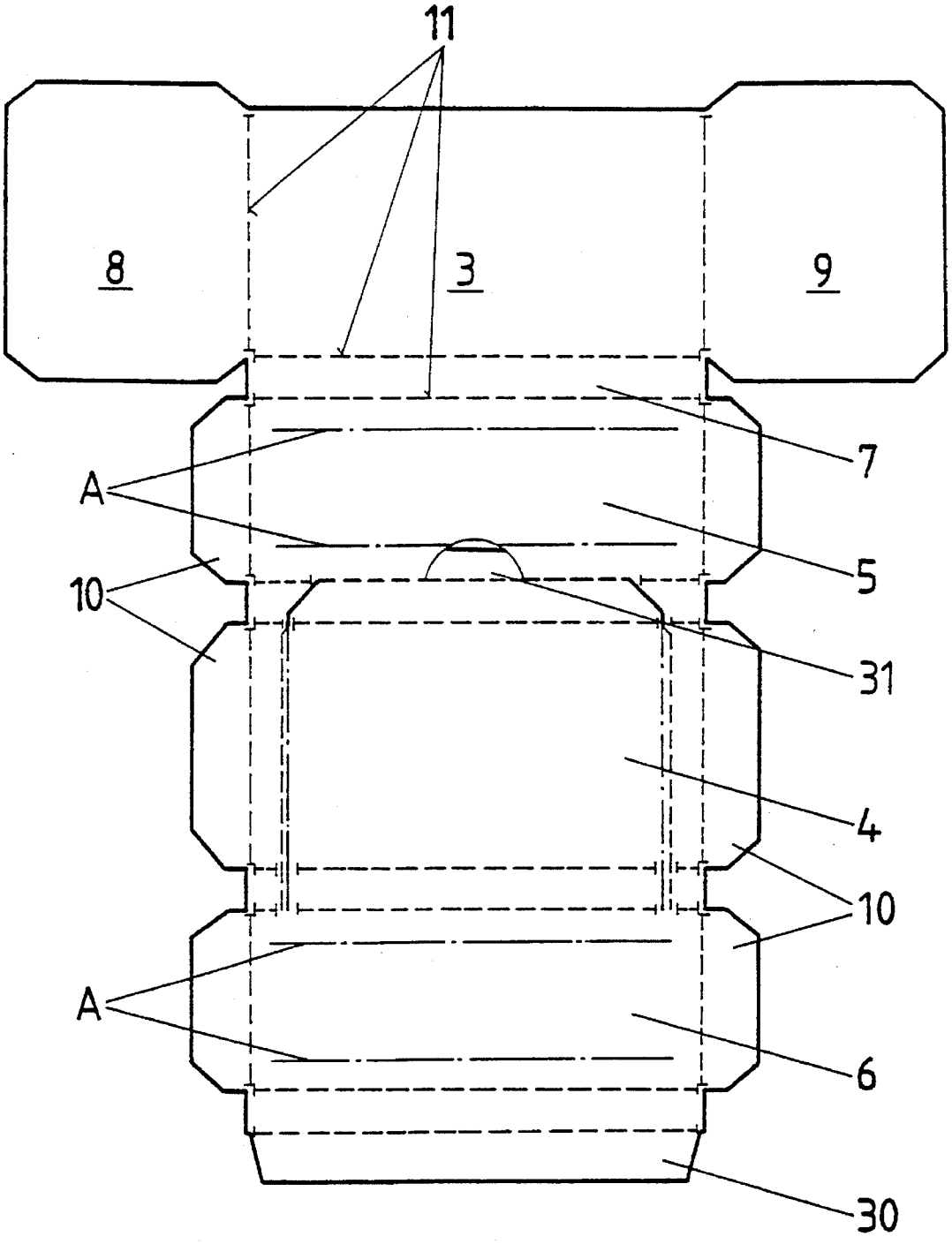
FIG. 2 is a side view of the flattened blank used to make the packing carton body shown in FIG. 1.

The structure of a packing carton 1 according to the invention is described with reference to FIGS. 1 to 3. FIG. 2 shows the blank 2 used to make the body of packing carton 1. It consists of a base panel 3, a top panel 4, a pair of matching side panels 5, 6, narrow bordering corner strips 7, a pair of lateral tabs 8, 9 extending from base panel 3 for forming the end walls of the carton body, and three pairs of glue tabs 10 extending laterally from opposite sides of each of panels 4, 5 and 6. The transitions between all the named components is by means of fold lines 11. Side panel 5 is interposed between base and top panels 3, 4, and top panel 4 is interposed between side panels 5, 6. By folding the blank 2 along the fold lines or creases 11, the packing carton 1 according to the invention shown in FIG. 1 is produced. By slanting the corners between the top panel 4 and the side panels 5, 6 and between the base panel 3 and the side panels 5, 6, respectively, using the narrower bordering corner strips 7, an octagonal cross-section results, which is intended for reasons of design.

The working space 12 of the packing carton 1 is defined by the space between the top panel 4 and the base panel 3, which space serves to house a bundle of five cigarette packets lying upon one another. Because of the selected octagonal cross-section, side zones or portions 13 arise at both sides of the working space 12 which have a cross-section in the form of an equilateral trapezoid.

Each side zone 13 is to be filled by an insert 14 in order to give the packing carton 1 the necessary shape stability, independent of the degree of filling with cigarette packets. The inserts 14 have means on the side directed towards the top panel 4 of the packing carton 1 for engaging a tab 31 of the top panel 4. This means may comprise an incision 32 into which the tab 31 can be inserted after the packing carton 1 has been torn open in order to close it again.

The top panel 4 of the packing carton 1, and optionally portions of the adjoining corner panels 7, are provided with perforated lines 33 which permit the top panel 4 to be torn open in defined manner for the opening of the packing carton 1. Perforations 33 preferably consist of three lines that define a generally rectangular flap which opens on a side wall of the carton body. Tab 31 is formed at the middle of the lengthwise perforation 33 as shown, and for this purpose the perforation 33 extends over into panel 5.

Figure 3:
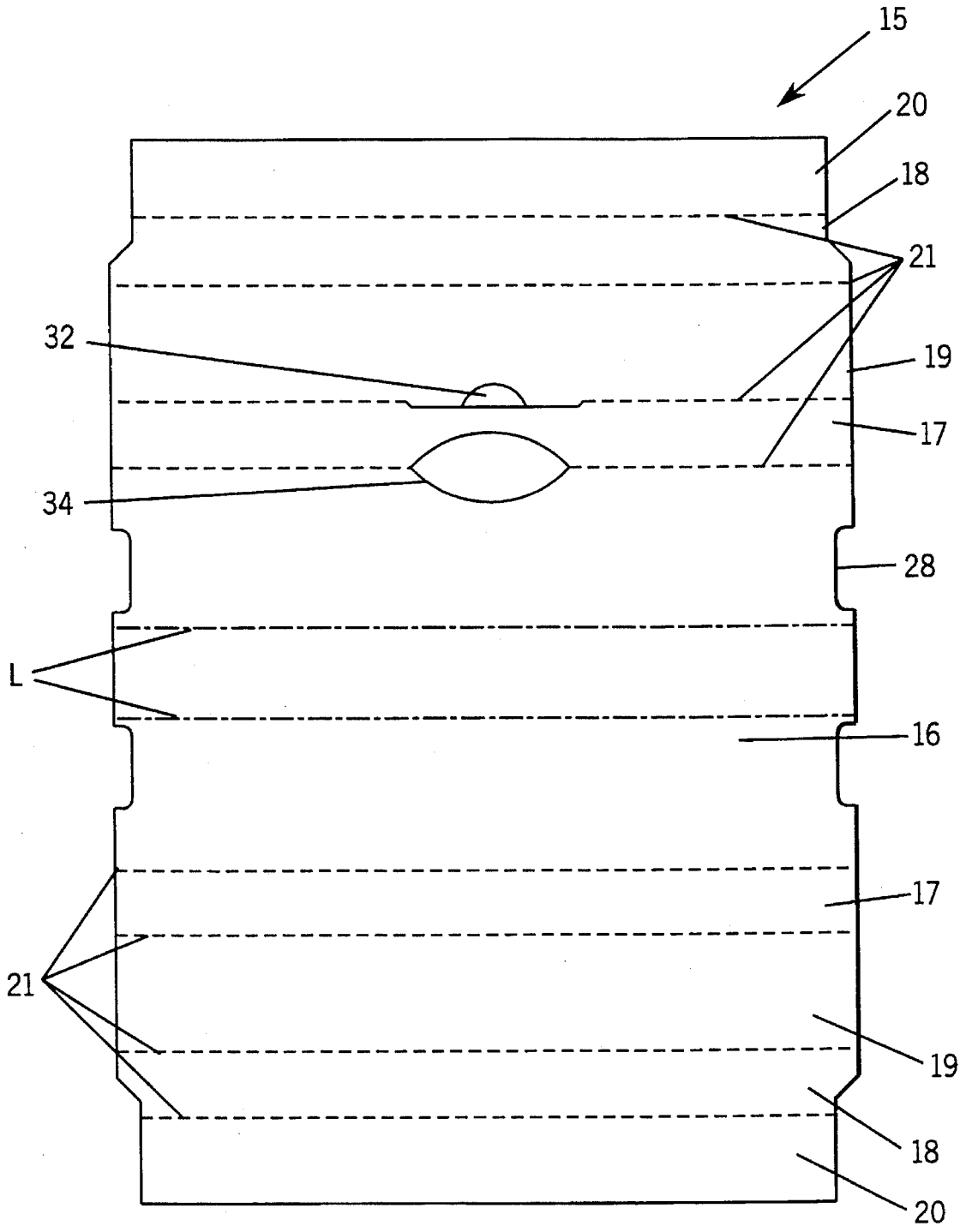
FIG. 3 is a side view of the flattened blank used to make the inserts shown in FIG. 1.

FIG. 3 shows the inside of a blank 15 used to make insert 14. Blank 15 consists of a base panel 16 which is symmetrically and successively bordered on each side by an inner channel side wall 17, a channel top wall 19, an outer channel top wall 18 and an end paste tab 20. The transition between the named components is by means of fold lines 21. By folding the blank 15 along the fold lines 21 and pasting the outer side of the paste tab 20 to the inner side of the panel 16 at a pre-determined spot, for example along each dashed-dotted line L, an insert 14 is produced which has channels 22 having rectangular cross-section along the side of the base panel 16.

Figure 4:
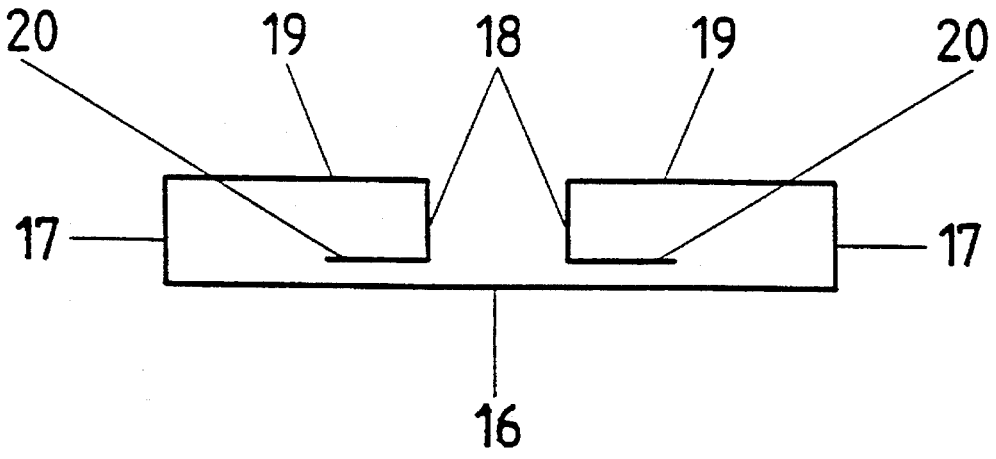
FIG. 4 is a schematic representation of the folding of an insert of FIG. 1 prior to gluing to the blank.
Figure 5:
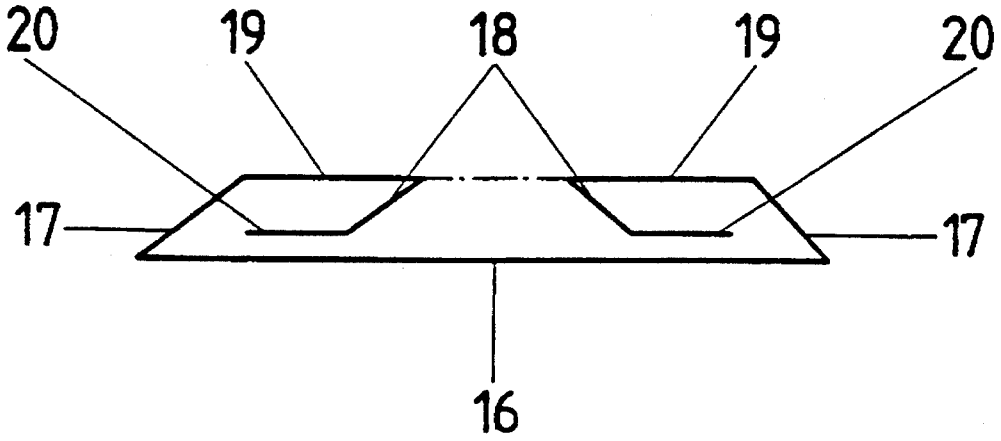
FIG. 5 is a schematic representation of the insert of FIG. 4 in pressed-together form for gluing to the blank; and FIGS. *6a* to *6d* are a schematic representation of the steps of the method for manufacture and the filling of the packing carton according to the invention.

By restricted pressing-together or pulling-apart of insert 14, the cross-sectional shape of the channels 22 shifts from the rectangular shape according to FIG. 4 into the shape of rhombi inclined towards one another according to FIG. 5. In this shape, the insert 14 has a cross-section in its totality which is matched to the cross-section of the trapezoidal side zones 13 of the packing carton 1. This is indicated by the dashed-dotted line in FIG. 5. The insert 14 is glued with its side facing the side wall 5 or 6 in the regions of the channels 22 to the side wall 5 or 6. For this purpose, the width of the panel 16 corresponds to the height of the interior working space 12 given by the distance between the base panel 3 and top panel 4. FIG. 3 also shows a cut-out section 34 which, after the blank 15 has been folded and pasted, forms a semi-circular opening at one edge of the insert 14 by means of which the packets introduced into the packing carton 1 can be removed more easily.

Figure 6A:
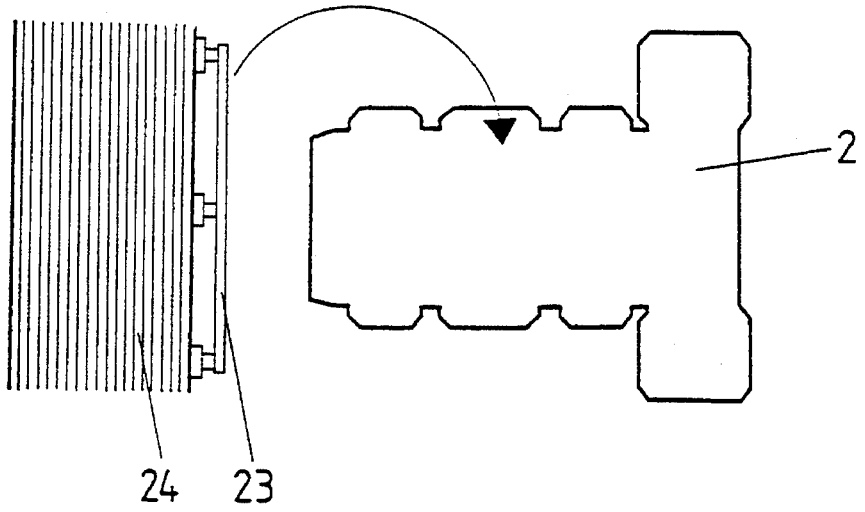
Figure 6B:
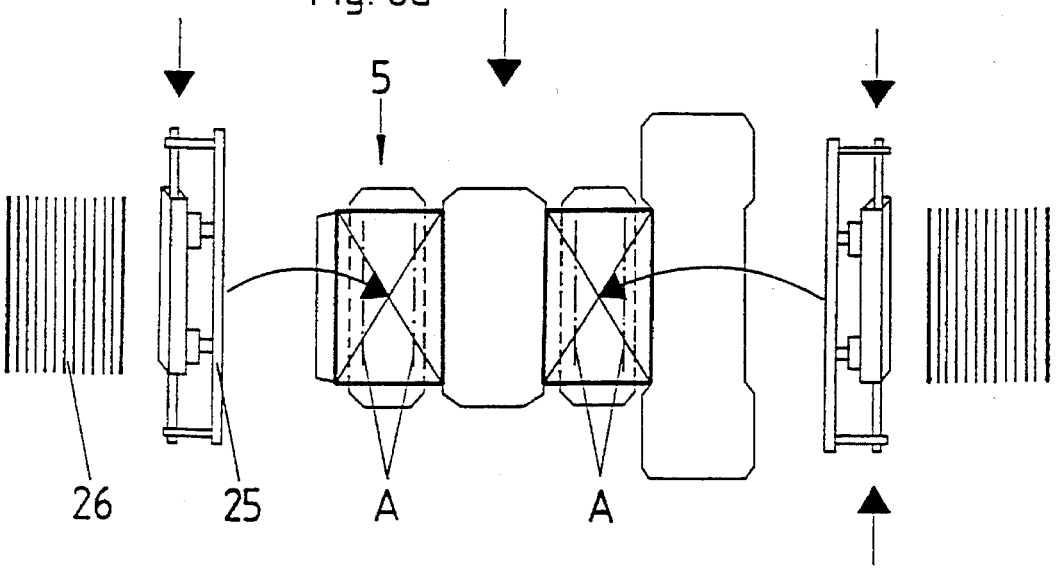
Figure 6C:
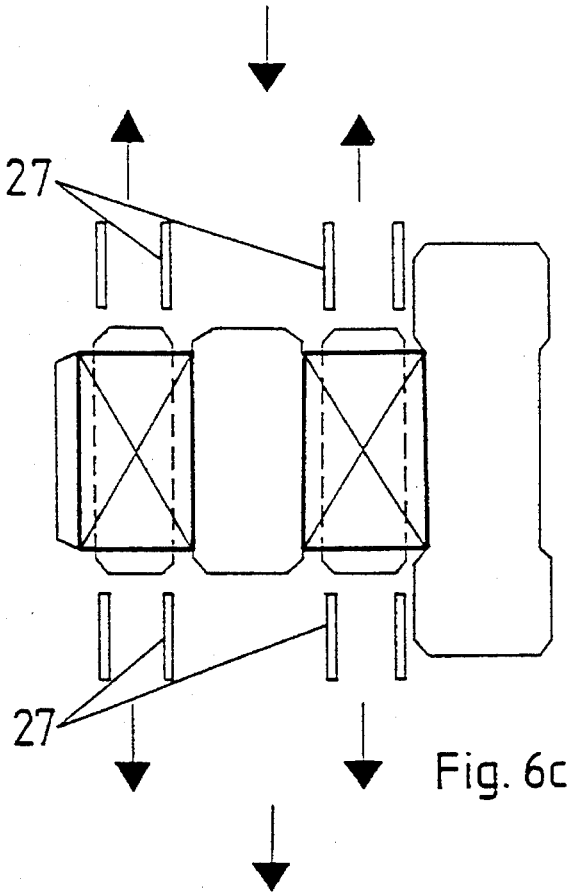

The technological flow during production and filling of the packing carton 1 is described with reference to FIGS. 6*a* to 6*d*. As FIG. 6*a* shows, the blank 2 of the packing carton 1 is removed by means of suction devices 23 from a carton magazine 24 which is equipped with a forward-feed system which is not shown. The blank 2 is then placed on a plate and transferred to a toothed-belt transportation system which is likewise not shown. It is driven by a servo-drive.

The toothed-belt transportation system conveys the blank 2 of the packing carton 1 to the distribution position for the inserts 14. During transportation, the necessary coatings of glue A are applied to the corresponding areas of the sides 5, 6 for the sticking-on of the inserts 14. FIG. 2 is also referred to in this respect.

The inserts 14 according to FIGS. 4 or 5 are preformed and secured by adhering the glue tabs 20 to the panel 16 as described above. The formed inserts 14 are transferred to the blank 2 using a suitable feed device, whereby both inserts 14 and the blank 2 are introduced and transferred at the same time. The inserts 14 are removed from magazines 26 provided therefor using suction devices 25. For this purpose, the inserts 14 are stored folded flat. On removing them from magazine 26 using suction devices 25, the channels 22 of the inserts 14 expand slightly. Shaping fingers 27 arranged in pairs at both sides of the inserts 14, which expand the channels 22 into the described rhomboid cross-section, are introduced into this gap. For this purpose, the fingers 27 are firstly guided from above through the openings 28 in the panel 16 and distributed on the opposite wall 19 of the channel 22. The pairs of fingers 27 lying opposite each other are then moved with respect to each other and open the insert 14 to the desired shape and height.

In this state, inserts 14 are pressed against the exactly-positioned blank 2 of the packing carton 1 lying underneath them and are fixed in the region of the sides 5, 6 with the coatings of glue A located there. After the distribution and the associated gluing process, which is completed in a few seconds and thereby forms a firm glued seam, the fingers 27 are pulled out of the insert 14 (FIG. 6*c*) and the suction device 25 swings into the takeover position at the magazine 26. The distance between the channel top walls 19 is fixed by the step of gluing to the sides 5, 6, and the inclination of the channels 22 is thereby established. The shape of the inserts 14 shown in FIG. 5 is thereby made stable.

After depositing the inserts 14, the toothed-belt transportation system is again started and conveys the completed blank 2 over the loading station of the carton transport chain. After leaving the toothed belt transportation system, centering fingers provide for an exact positioning of the completed blank. The carton transport chain consists of uptake stations with integrated folding fingers for the exact determination of the longitudinal slopes. The drive takes place via a stepping-gear system. A lower die which supports the blank 2 from below is controlled from below, through the loading station.

Figure 6D:
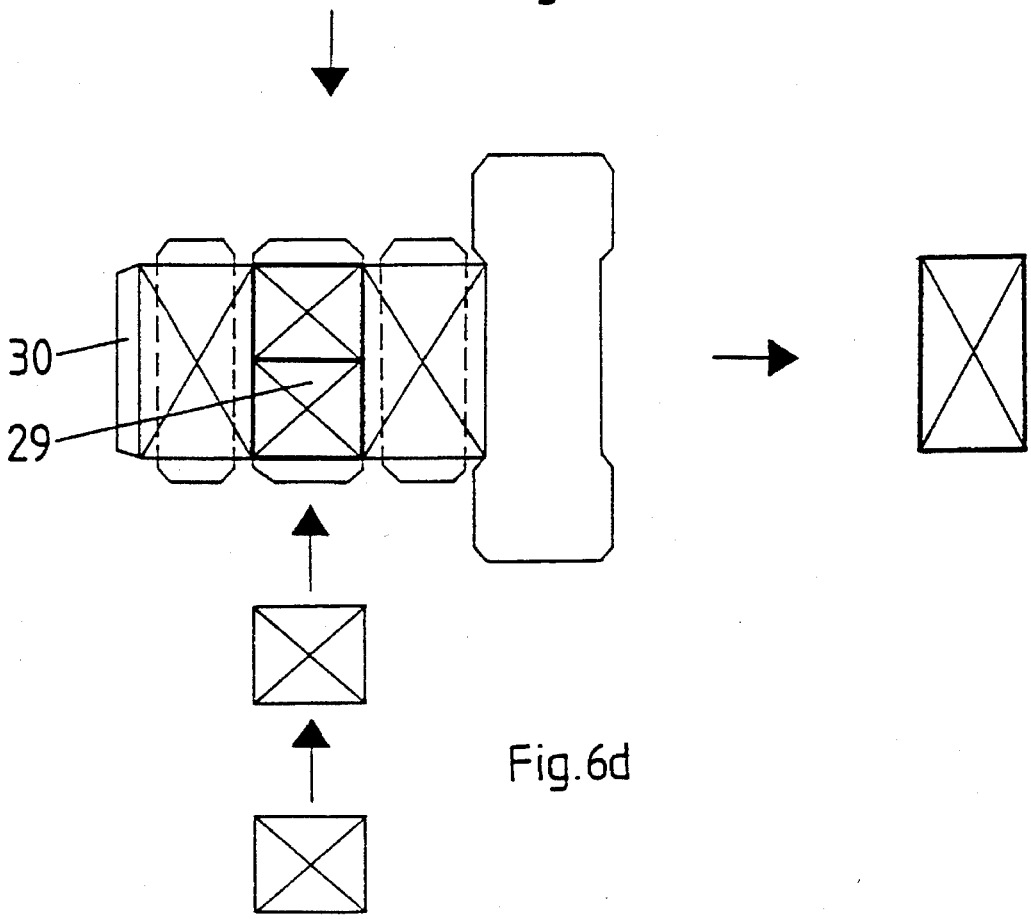

The prepared cigarette packet stack, the bundle 29, is pushed by a pusher from the stacking station onto the laid-out blank 2 of the packing carton 1 (FIG. 6*d*). The upper die, mounted above the loading station, is then started and presses the completed blank 2 and the bundle 29, with simultaneous dipping of the lower die into the loading station of the carton transport chain. The blank 2 with the bundle 29 thereon then assumes a U-shape in the chain compartment of the carton transport chain.

After one chain cycle of the carton transport chain, the rear folding fingers, seen in the direction of travel, position the glue tabs 10. During the subsequent chain cycle, the side tabs 8, 9 are positioned and the glue tabs 10 glued. During the further chain cycles, the top panel 4 is positioned and pressed on. The glue tab 30 is then folded in, and the glue tab 30 is then coated with glue and stuck. The completed cartons are then transferred to a removal belt.

It will be understood that the foregoing description is of preferred exemplary embodiments of the invention, and that the invention is not limited to the specific forms shown. Modifications may be made in without departing from the scope of the invention as expressed in the appended claims.

We claim:

1. A packing carton, comprising:

a carton body having an octagonal cross-sectional shape and an octagonal interior; and a pair of inserts having a trapezoidal cross-sectional shape geometrically similar to a pair of opposed side portions of the interior of the carton body, each insert comprising a single folded blank having a pair of end portions which have been folded and pressed towards each other into inclined rhombohedral shapes in order to fit within the side portions of the interior of the carton body.

2. The carton of claim 1, further comprising adhesive coatings formed on an inner surface of a side wall of the carton body which bond the inserts to the carton body.

3. The carton of claim 2, wherein each insert comprises a central panel forming a base of the trapezoid and having an outer surface facing the interior of the carton, and the end portions comprise four successive walls separated by fold lines, an endmost one of the four walls being in face to face contact with an inner surface of the central panel, each insert being compressible from a rectangular cross-sectional shape to a narrower trapezoidal cross-sectional shape.

4. The carton of claim 3, wherein the central panel has a pair of spaced, lengthwise notches in an end thereof located near opposite ends of the central panel and configured to permit gripping of the insert by fingers of a gripping machine.

5. The carton of claim 3, wherein the folded end portions of each insert are spaced from each other.

6. The carton of claim 1, wherein the carton body has a perforation configured for opening the carton along a side thereof and thereby forming a flap, and one of the inserts has an incision positioned so that a closing tab on the flap can be inserted into the incision to re-close the carton.

7. The carton of claim 4, wherein the perforation defines a generally rectangular flap which opens on a side wall of the carton body.

8. The carton of claim 3, further comprising adhesive coatings for adhering each endmost one of the four walls to the interior surface of the central panel of each insert.

* * * * *